US007143563B1

(12) United States Patent
Palmer

(10) Patent No.: US 7,143,563 B1
(45) Date of Patent: Dec. 5, 2006

(54) TIE AND TIE METHOD FOR BINDING TOGETHER ADJACENT SUPPORT ELEMENTS

(76) Inventor: Douglas A. Palmer, 1229 Trieste Dr., San Diego, CA (US) 92107

( * ) Notice: Subject to any disclaimer, the term of this patent is extended or adjusted under 35 U.S.C. 154(b) by 19 days.

(21) Appl. No.: 10/442,712

(22) Filed: May 20, 2003

(51) Int. Cl.
*E04C 5/16* (2006.01)

(52) U.S. Cl. ..... 52/677; 52/685; 52/719; 52/736.2; 52/712

(58) Field of Classification Search ..... 52/677, 52/684, 685, 686, 687, 649.1, 719, 736.2, 52/724.5, 712; 24/339; 403/400, 397, 396, 403/207
See application file for complete search history.

(56) References Cited

U.S. PATENT DOCUMENTS

| | | | | | |
|---|---|---|---|---|---|
| 946,987 | A | * | 1/1910 | Schade | 52/684 |
| 1,060,919 | A | * | 5/1913 | Luten | 52/684 |
| 1,078,510 | A | * | 11/1913 | Luten | 52/252 |
| 1,185,263 | A | | 5/1916 | Symons | |
| 1,361,558 | A | * | 12/1920 | White | 52/684 |
| 1,512,763 | A | | 10/1924 | Holmgreen | |
| 1,668,953 | A | * | 5/1928 | Erickson | 174/101 |
| 1,986,172 | A | * | 1/1935 | Wilson | 52/520 |
| 2,260,974 | A | * | 10/1941 | Healey et al. | 52/684 |
| 2,409,342 | A | * | 10/1946 | Cassidy | 52/684 |
| 2,657,890 | A | * | 11/1953 | Atkins | 248/68.1 |
| 3,169,559 | A | | 2/1965 | Working, Jr. | |
| 3,234,616 | A | | 2/1966 | Wantland | |
| 3,300,930 | A | * | 1/1967 | Weise | 52/309.1 |
| 3,302,348 | A | | 2/1967 | Pratt | |
| 3,694,989 | A | * | 10/1972 | Oliver et al. | 52/678 |
| 3,786,841 | A | | 1/1974 | Albrecht et al. | |
| 4,388,791 | A | | 6/1983 | Anderson | |
| 4,783,029 | A | * | 11/1988 | Geppert et al. | 248/74.1 |
| 4,798,231 | A | | 1/1989 | Glaus et al. | |
| 5,178,195 | A | | 1/1993 | Giaus et al. | |
| 5,431,196 | A | | 7/1995 | Forrester, Jr. et al. | |
| 5,509,636 | A | * | 4/1996 | Cotugno | 249/91 |
| 5,653,411 | A | * | 8/1997 | Picco et al. | 248/74.1 |
| 5,791,816 | A | * | 8/1998 | McCallion | 404/136 |
| 5,893,252 | A | * | 4/1999 | Hardy et al. | 52/685 |
| 5,913,341 | A | | 6/1999 | Jones | |
| 6,128,882 | A | | 10/2000 | Jones | |
| 2002/0122843 | A1 | * | 9/2002 | McGrew et al. | 426/3 |

* cited by examiner

*Primary Examiner*—Carl D. Friedman
*Assistant Examiner*—Chi Q. Nguyen
(74) *Attorney, Agent, or Firm*—Gordon & Rees LLP

(57) ABSTRACT

A tie and a tie method for binding together adjacent support elements such as concrete reinforcing bars by employing a tie having a frame which can be disposed about the bars, and a wedge adapted to be forcibly driven between resilient portions of the frame and the bars to develop a biasing face which compresses the bars together.

16 Claims, 4 Drawing Sheets

TIE AND TIE METHOD FOR BINDING TOGETHER ADJACENT SUPPORT ELEMENTS

BACKGROUND OF THE INVENTION

1. Field of the Invention

The present invention relates to a tie and tie method for binding together adjacent support elements, and particularly to ties and methods for binding together reinforcing bars (rebar) in reinforced concrete construction.

Rebar improves the tensile strength and impact resistance of concrete, minimizes crack separation, and provides localized reinforcement and other improvements well known in the art. Accurate placement and positioning of the rebar is essential to achieve successful results.

2. Description of the Prior Art

Sections of rebar are typically arranged and tied together with lengths of wire to form a reinforcing structure or cage into and around which concrete is poured to form the reinforced concrete structure. In this process the initially tied portions must be tied securely enough to maintain their particular orientation and assembled positions during subsequent tying of the remaining portions by workers stepping on and clambering over the structure.

The process of looping wire around adjacent sections of rebar takes considerable skill, is labor intensive and tiring. If not done properly, a reinforced structure formed of tied rebar can collapse and cause considerable damage and injury to workers.

Various methods and power tools have been developed to aid in tying rebar. For example, U.S. Pat. No. 1,512,763 (Homgreen) describes a wire clip to connect crossed rebars in a diagonal manner. U.S. Pat. No. 1,185,263 relates to a spring clip to tie together crossed rebars. U.S. Pat. No. 3,169,559 (Working) discloses a wire tying tool to apply U-shaped wires over crossed rebars. U.S. Pat. No. 3,234,616 (Wantland) relates to looped wire ring fasteners. U.S. Pat. No. 3,302,348 (Pratt) describes a wire hanger system to hold rebar in place in prestressed concrete beams. U.S. Pat. No. 3,786,841 (Albrecht et al) discloses special tools for twisting and tying a wire. U.S. Pat. No. 4,388,791 (Anderson) describes a spring wire clip that is snapped over crossed rebars. U.S. Pat. No. 4,798,231 (Glaus et al) relates to a wire clamp and tool to apply it. U.S. Pat. No. 5,431,196 (Forrester et al) describes a power tool for applying wire from a feed to intersecting rebar. U.S. Pat. No. 5,913,341 (Jones) describes a geared tying device to apply wire bundling around rebar, and U.S. Pat. No. 6,128,882 (Jones) describes a hooked spring wire that ties together two pieces of rebar.

None of these devices or methods meet important needs or requirements of the reinforced concrete industry, particularly the need for a strong non-wire tie that can be quickly applied, is removable, and is capable of developing symmetric forces that will not warp or unbalance the tied cage structure and cause instability prior to and during the pouring of concrete.

SUMMARY OF THE INVENTION

According to the present invention, a tie is provided which is effective to quickly and easily bind together sections of rebar to form a reinforcing structure or cage around or within which concrete is poured to form the desired reinforced concrete structure. The sections of rebar may be arranged in any desired pattern or orientation, depending upon the structure being built. The most common patterns are arrangements of the sections in intersecting relation or in parallel, stacked or superposed relation for tying them together.

The tie of the present invention comprises an open-ended frame and an elongated wedge which cooperate to bind together adjacent lengths of rebar. Whether the lengths are arranged in intersecting or parallel relation, the opposite sides of the frame are located to extend upwardly of the base of the frame, adjacent to the lowermost or first bar. The wedge is then positioned upon the overlying or second bar.

Claws are located on the upper extremities of the sides or, in one embodiment, on the upper extremities of pairs of legs that form the sides, to engage the sides of the wedge and hold it in position on the second bar. One method according to this invention involves pivotal mounting of one side of the wedge to the claws at one side of the frame. A hammer blow or the like on the opposite side of the wedge then forcibly pivots the wedge downwardly to forcibly position the opposite set of claws over the opposite side of the wedge. The legs are made resilient and when forced apart develop a continuing bias that urge the wedge downwardly upon the second bar, forcibly holding the first and second bars together in tied or binding relation.

According to another method of the invention, the wedge is not pivoted to the claws but instead is longitudinally arranged at one end of the elongated frame so that a hammer blow on its end will axially drive the wedge beneath the nearer set of claws, and then beneath the second set of claws, thereby deforming the resilient claws and developing the continuing bias necessary for tying or binding the ties together.

The proper placement of the frame and wedge depends upon whether the bars are in intersecting or parallel relation. If they are disposed in intersecting relation, the frame is positioned so that the first or lower rebar extends through aligned openings in the opposite sides of the frame. The opening in one side is defined between the axially spaced pair of legs on that side, and the opening in the other side is similarly defined between the axially spaced pair of legs on that side. The opposite extremities of the first bar then rest upon the lower margins of the opposite openings.

The wedge is next placed upon the second or upper bar which overlies or rests upon the first bar, in position for it to be driven into forcible engagement with the claws.

In a stacked arrangement of the first and second bars, the frame is arranged so that its open ends accept the first bar for resting of the first bar rest upon the base of the frame. The second bar rests in parallel relation on top of the first bar, and the legs on opposite sides of the frame extend upwardly adjacent the opposite sides of the second bar. The wedge is next placed upon the top of the second bar for forcible engagement with the claws of the oppositely disposed legs to tie or bind the two bars together. Other arrangements of the components are also described in the specification.

Whether intersecting or stacked, the rebar sections are thus quickly and easily assembled by a frame and wedge which interact to continuously generate the relatively high binding forces required to produce a secure and stable reinforcing structure.

Various objects and features of the present invention will become apparent from the following description taken in conjunction with the accompanying drawings.

DESCRIPTION OF THE PREFERRED EMBODIMENTS

Figure 1:
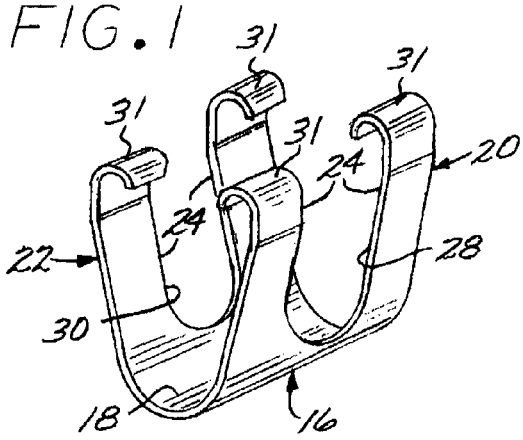
FIG. 1 is a perspective view of the base of the tie of the present invention.

Referring now to the drawings, and particularly to FIGS. 1–12, a fastening device or tie 10 is illustrated which is particularly adapted to exert a continuing bias to securely bind together and maintain individual sections or lengths of steel reinforcing bars (rebar) 12 and 14 in precisely oriented relationships to provide a support structure or cage adapted to reinforce poured concrete. Such structures are well known to those skilled in the art and further description of such structures is omitted for brevity.

Although the tie 10 is described as it would be used in a reinforced concrete application, it is also adapted to tie or bind together rods or similar structural support elements that are assembled to define various kinds of structure, particularly a self supporting structure.

The tie 10 is adapted to permanently bind together rebar, in a rapid and very secure manner at low cost, and it is also adapted to be relatively quickly removed if it is desired to disassemble the associated rebar support structure for some reason, as in the case of a structure that is intended only as a temporary structure.

In the description which follows, the terms "lower", "underlying", "upper" "overlying", "lower" and similar terms of orientation are used in a relative rather than in an absolute sense. Obviously, for example, a bar which is the lower bar in one orientation would be termed outwardly disposed rather than downwardly if the parent structure were reoriented to face in a different direction. In other words, such terms are used in the manner indicated only as a matter of convenience and not by way of limitation.

The tie 10 is preferably made of high strength steel whose components are resilient and therefore capable of deflection or deformation from initial positions, but also characterized by development of a strong restoring force or bias which acts to return the components to their initial positions. As will be seen, this bias characteristic is effective to bind together adjacent support elements such as cylindrical, axially extending concrete reinforcing rods or bars 12 and 14.

Figure 3:
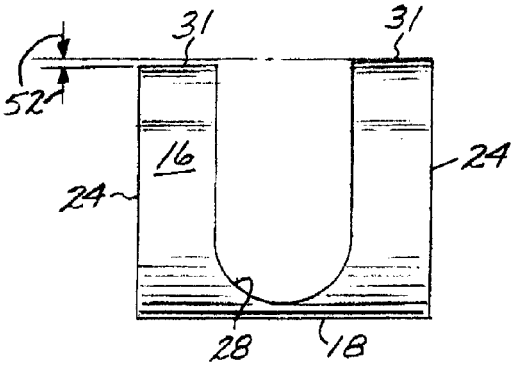
FIG. 3 is a side elevational view of the base of FIG. 1.
Figure 5:
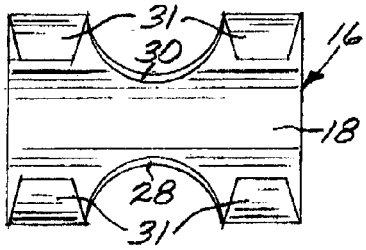
FIG. 5 is a top plan view of the base of FIG. 1.

As seen in FIGS. 1, 3 and 5 the tie 10 comprises a retainer or frame 16 which includes an arcuate, upwardly open base 18 which is preferably U-shaped to form opposite sides 20 and 22 which are integral with and extend upwardly from the base 18.

One side 20 is formed or cut away to define a pair of vertically elongated legs 24 which are axially spaced apart to define a vertically extending slot or opening 28. Likewise, the opposite side 22 is formed or cut away to define a pair of vertically elongated legs 26 which are axially spaced apart to form a vertically extending slot or opening 30. The bottom of each of the openings 28 and 30 is arcuate or semicircular to more closely support the cylindrical shape of the lower bar 12 when it is disposed through the openings 28 and 30 in the manner illustrated in FIG. 7.

The upward extremities of the legs 24 and 26 are each curved to form a retainer or claw 31 characterized by a downwardly opening groove which, as will be seen, is designed to receive the side edge 36 of a wedge 32 which is a part of the tie 10.

The bias member or wedge 32 is elongated, made of resilient steel or the like, and is preferably curvilinear or concave in its central portion 32 in order to closely engage the semicircular top of the upper bar 14. The frame 16 and wedge 32 are designed to interact to compress or urge together the frame 16, wedge 32, lower bar 12 and upper bar 14 into the desired tied or locked relation. For this purpose the lateral extremities of the sides of the wedge 32 are configured to include upwardly directed side edges 36 adjacent elongated side grooves 38, respectively, which are formed between the side edges 36 and the central portion 32.

Figure 9:
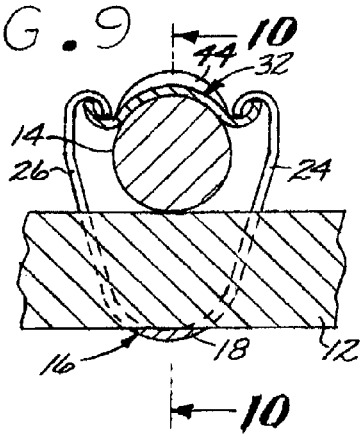
FIG. 9 is a view taken along the line 9—9 of FIG. 7.
Figure 10:
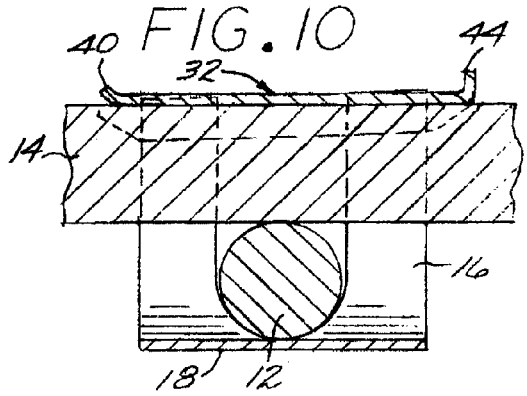
FIG. 10 is a view taken along the line 10—10 of FIG. 9.

As previously indicated, and as best seen in FIGS. 9 and 10, the wedge 32 can be forced into its wedging position by placing one side edge 36 within the grooved undersides of the adjacent claws 31 so that the wedge 32 can pivot about the claws 31 into engagement with the oppositely located claws 31. In this engaged position a sharp blow on the top or free edge of the wedge 32 will cause the wedge 32 to outwardly deform the engaged claws 31 until the claws 31 are located over the adjacent side groove 38 of the wedge 32. The resilience of the claws 31 then biases the claws 31 inwardly until they drop down into and locate the adjacent side edge 36 in the grooved undersides of the claws 31. In this position the wedge 32 is constantly biased downwardly by the resilient claws to bind together the wedge 32, the top or second bar 14 and the underlying first bar 12.

Preferably, the wedge 32 is axially driven into position with its side edges 36 within the upper extremities of the claws 31 by first placing the wedge 32 on top of the upper bar 14 with its front edge adjacent one set of claws 31. The front edge of the wedge has an end flare 40 to better enable it to easily ride over the customary circumferential ridges 42 which characterize steel rebar. The rear edge of the wedge also has a tongue 44 which can easily be struck by a hammer or the like to drive the wedge axially until its side edges 36 are located within both sets of claws 31.

Figure 4:
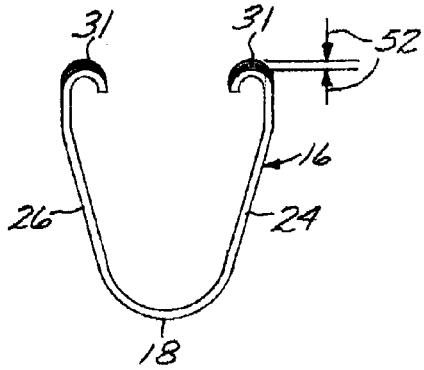
FIG. 4 is a left end elevational view of the base of FIG. 1.

As best seen in FIGS. 3 and 4, the claws 31 are angled slightly downwardly to the extent indicated by the arrows 52. The wedge 32 is itself complementally tapered to accommodate the taper of the claws. Thus, when the wedge 32 is in its operative position, as seen in FIG. 6 or 7, the respective complemental wedge angles will result in seating of the wedge 32 in close, parallel and coextensive engagement with the adjacent bar 14.

Figure 2:
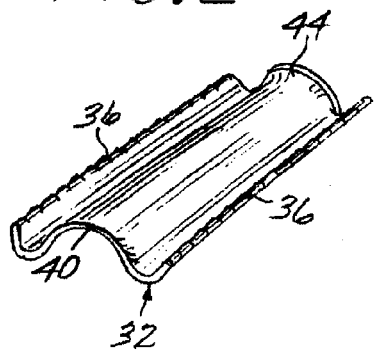
FIG. 2 is a perspective view of the wedge of the tie.
Figure 6:
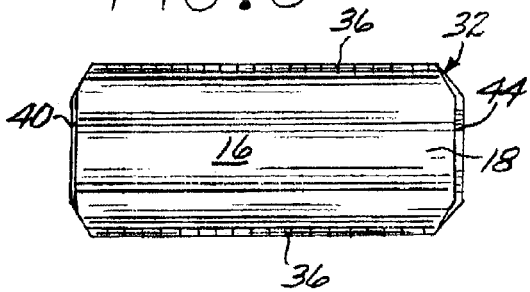
FIG. 6 is a top plan view of the wedge of FIG. 2
Figure 7:
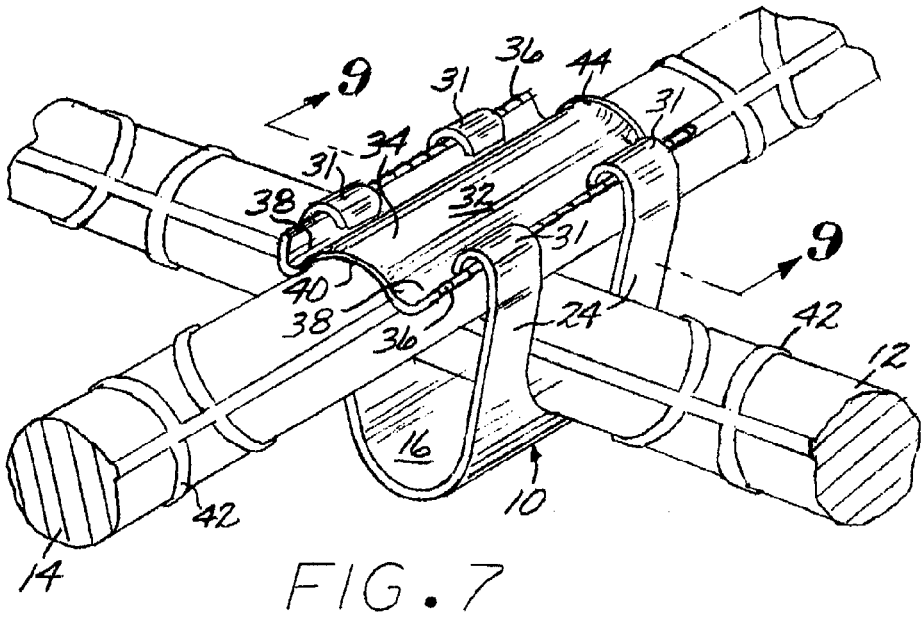
FIG. 7 is a perspective view of the tie as it would appear in tying relation with a pair of intersecting rebar.

Also, as best seen in FIGS. 2 and 6, the side edges 36 of the wedge 32 are preferably arranged in a saw tooth-like configuration so that the sloping or ramp portions of the teeth allow the wedge 32 to be driven forwardly under the claws 31, but the more abrupt non-sloping ramp ends tend to engage the end of the wedge 32 and prevent it from moving reversely.

With this arrangement the tie 10 holds the bars 12 and 14 together during rebar placement, and forming and concrete pouring stages of construction of concrete reinforced structures. Rebar is very heavy and the prior art systems of utilizing wire to hold the rebar is not reliable. Wired rebar can easily topple or collapse under its own weight or when tons of concrete are poured over it.

The tie 10 can be secured in position quickly. The construction worker simply has to loop the frame 16 in position around the bars 12 and 14, slip the wedge 32 into position over the upper bar 14, and strike it with a hammer. This securely clamps the bars 12 and 14 together with considerable force. The tie 10 is preferably fabricated from heavy gauge steel so that it can securely clamp the bars together with thousands of pounds of force. Such a strong force is exerted that it significantly reduces the number of ties that need to be used, compared with conventional wire ties. Moreover, the resulting tied or bound structure will likely retain its structural integrity even if the concrete were pulverized by some violent event such as impact by a heavy vehicle, or an earthquake or the like.

Figure 8:
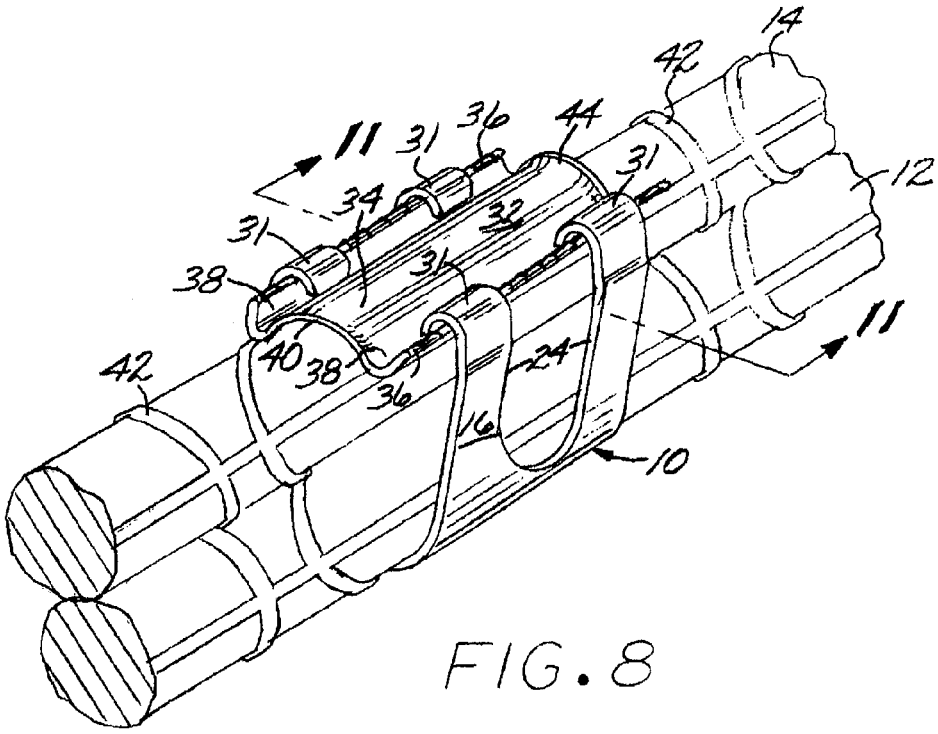
FIG. 8 is a perspective view of the tie as it would appear in tying relation with a pair of superposed rebar.
Figure 11:
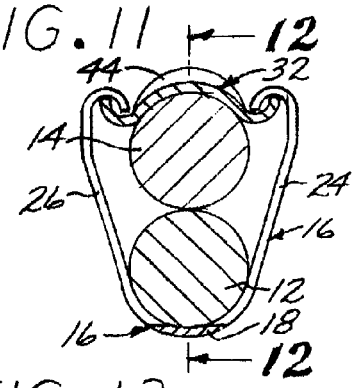
FIG. 11 is a view taken along the line 11—11 of FIG. 8.
Figure 12:
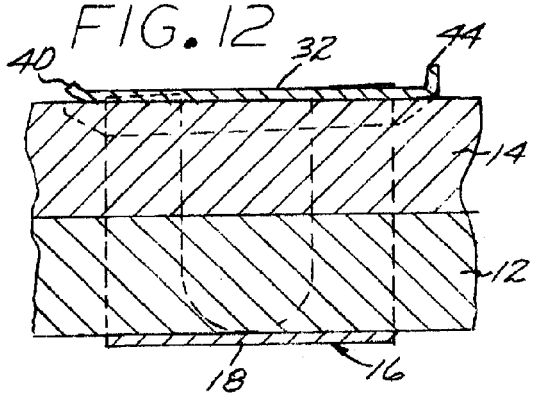
FIG. 12 is a view taken along the line 12—12 of FIG. 11.

In an application where the bars 12 and 14 are arranged in parallel of stacked relation, as seen in FIGS. 8, 11 and 12, the frame 16 is positioned with the lowermost or first bar 12 disposed through the end openings of the frame, with the lower bar 12 resting upon the base 18, and the upper bar 14 resting upon the bar 12, as best seen in FIGS. 11 and 12. Either of the two methods previously described may be used for locating the wedge 32 in position within the claws of the frame 16 to develop the bias force that continuously and firmly presses the bars 12 and 14 together.

Figure 15:
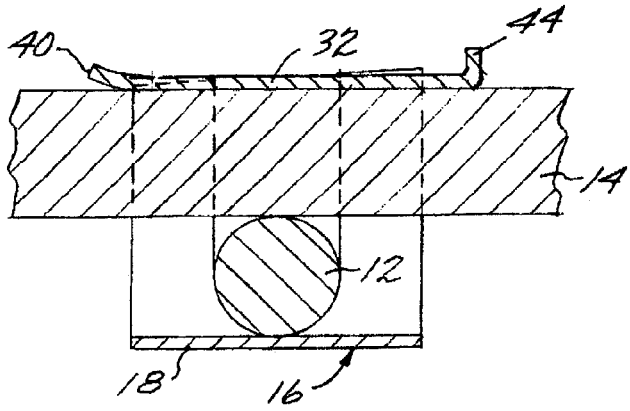
FIG. 15 is a view similar to FIG. 10, but illustrating the lower bar extending through the open ends of the frame, and the use of modified wedge and claw configurations.
Figure 16:
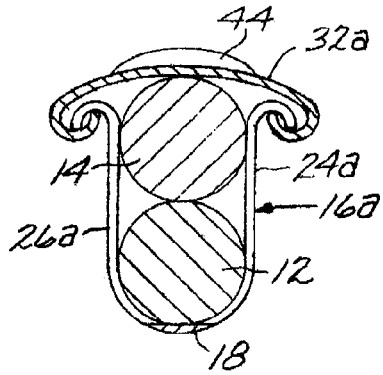
FIG. 16 is a view similar to FIG. 11, but using modified wedge and claw configurations.

Further embodiments are shown in FIGS. 15 and 16. These operate in much the same way as the embodiments previously described, i.e. the biasing action of the wedge 32 in its operative position acts to forcibly and continuously urge the bars 12 and 14 against each other. In FIG. 15, instead of orientation of the bar 12 through the aligned side openings of the frame 16 as seen in FIG. 7, the bar 12 extends through the open ends of the frame 16.

Also, the lateral edges of the wedge 32*a* are downwardly and upwardly curved to closely fit within the upwardly and then downwardly curved lateral edges of the sides or legs 24*a* and 26*a* of the frame 16. This resilient interengagement is essentially the same as that described in the previously discussed embodiments of the invention.

Figure 13:
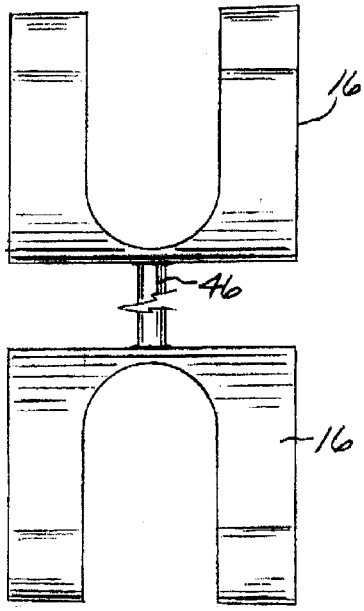
FIG. 13 is a side elevational view of a standoff comprising a pair of ties and an interconnecting support strut.
Figure 14:
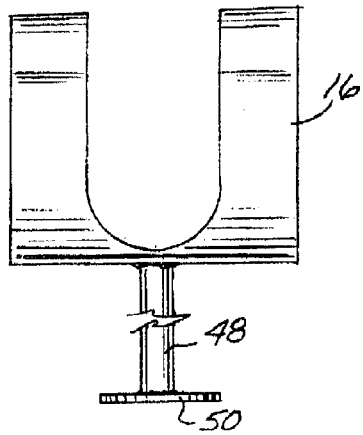
FIG. 14 is a side elevational view of a standoff comprising a standoff comprising a tie and a support strut and base.

As an optional feature, as illustrated in FIG. 13, rods or spacers 46 of appropriate lengths may be attached to adjacent frames 16 to establish and maintain accurate spacing between rebar meshes on each side of a wall or the top and bottom of a floor. Also, a support rod 48 of appropriate length, and a base 50 can be used, as seen in FIG. 14, to hold a tied joint away from a form or floor.

While preferred forms of the invention have been illustrated and described, it will be apparent that various modifications and changes can be made without departing from the spirit and scope of the invention.

The invention claimed is:

1. A tie for binding together adjacent concrete reinforcing bars, the tie comprising:

a frame including a base and elongated resilient sides extending from the base and terminating in arcuate claws defining grooves;

the base and sides together defining a generally U-shaped channel extending in a first axial direction, and the grooves in the arcuate claws extending parallel to the first axial direction; and an elongated wedge having lateral extremities adapted for forcible location within the grooves of the arcuate claws;

the base and sides together comprising means for engaging with a concrete reinforcing first bar and a concrete reinforcing second bar stacked on top of the first bar, and the wedge comprising means for engagement with an arcuate upper surface portion of the second bar whereby compressive forces are developed on the first and second bars to force them against one another between the base and the wedge;

wherein the elongated sides are each configured to define first and second pairs of legs, respectively, each of the legs of the first pair being spaced apart to define a first opening, and each of the legs of the second pair being spaced apart to define a second opening axially aligned with the first opening to define a through passage extending in a second axial direction transverse to the first axial direction for selectively receiving the first bar with the second bar overlying the first bar and extending in the channel in the first axial direction and transverse to the first bar, whereby the first bar can selectively be positioned in the base to extend in the first axial direction in the channel and parallel to the second bar, or in the through passage in a direction transverse to the second bar, the extremities of the first and second pairs of legs including the arcuate claws for engaging the wedge against the second bar to bind together the first and second bars regardless of the direction of the first bar relative the second bar.

2. A tie for binding together adjacent concrete reinforcing bars, the tie comprising:

a frame including a base and elongated resilient sides extending from the base and terminating in arcuate claws defining grooves;

the base and sides together defining a generally U-shaped channel extending in a first axial direction, and the grooves in the arcuate claws extending parallel to the first axial direction; and an elongated wedge having lateral extremities adapted for forcible location within the grooves of the arcuate claws;

the base and sides together comprising means for engaging with a concrete reinforcing first bar and a concrete reinforcing second bar stacked on top of the first bar, and the wedge comprising means for engagement with an arcuate upper surface portion of the second bar whereby compressive forces are developed on the first and second bars to force them against one another between the base and the wedge;

wherein the elongated sides are configured to define first and second pairs of legs, respectively, terminating in the arcuate claws that are adapted to develop compressive forces upon the first and second bars for binding them together.

3. The tie according to claim 2, wherein:

the lateral extremities of the elongated wedge are configured to define opposite grooves extending parallel to the first axial direction for receiving the arcuate claws of the sides, respectively, and wherein the grooves of the arcuate claws open downwardly, and the grooves of the wedge open upwardly.

4. The tie according to claim 2, wherein:

the lateral extremities of the elongated wedge are configured to define opposite grooves extending parallel to the first axial direction for receiving the arcuate claws of the sides, respectively, and wherein the grooves of the arcuate claws open upwardly, and the grooves of the wedge open downwardly.

5. A tie for binding together adjacent concrete reinforcing bars, the tie comprising:

a frame including a base for engagement with an underlying concrete reinforcing first bar, and further including elongated sides extending from the base and terminating in arcuate claws, the claws defining grooves, and the base and sides together defining a first through passage extending along a first axis;

an elongated wedge for engagement with a concrete reinforcing second bar overlying the first bar, the wedge including lateral extremities adapted for forcible location within the arcuate claws of the sides to develop compressive forces on the first and second bars for binding them together;

the frame having a first axis for holding a first bar and a second axis for holding a second bar, the first and second axes extending parallel to one another;

the elongated sides being configured to define first and second pairs of legs, respectively, the extremities of the first and second pairs of legs including the arcuate claws to develop compressive forces upon the first and second bars for binding them together;

the lateral extremities of the wedge have edges which slope towards the first axis in an axially extending tightening direction whereby, upon forcible movement of the wedge in the tightening direction for engagement of the lateral extremities within the arcuate claws, the arcuate claws impose progressively greater compressive forces upon the wedge and progressively increase the forces binding together the first and second bars.

6. The tie according to claim 5, wherein the slope of the edges of each of the lateral extremities is collectively defined by successive sloping ramps arranged in saw tooth fashion, whereby the reverse movement of the wedge away from the tightening direction is prevented whenever the claws move off the slope of one ramp and onto the slope of the next ramp.

7. A tie for binding together adjacent concrete reinforcing bars, the tie comprising:

a frame including a base and elongated resilient sides extending from the base and terminating in arcuate claws defining grooves;

the base and sides together defining a generally U-shaped channel extending in a first axial direction, and the grooves in the arcuate claws extending parallel to said first axial direction; and an elongated wedge having lateral extremities adapted for forcible location within the grooves of the arcuate claws;

the base and sides together comprising means for engaging with a concrete reinforcing first bar and a concrete reinforcing second bar stacked on top of the first bar, and the wedge comprising means for engagement with an arcuate upper surface portion of the second bar whereby compressive forces are developed on the first and second bars to force them against one another between the base and the wedge;

wherein the wedge includes first and second ends, and wherein the elongated sides are configured to define opposed first and second pairs of legs adjacent the first and second ends of the wedge, respectively, the extremities of the legs including the arcuate claws, the first pair of legs being longer than the second pair of legs to provide greater clearance for entry of the first end of the wedge under the claws of the first pair of legs upon axial slidable movement of the wedge toward the second pair of legs for location under the claws of the second pair of legs.

8. The tie according to claim 7, wherein the first end of the wedge includes a tongue to facilitate forcibly striking the wedge to force the wedge beneath the claws.

9. A pair of ties, each according to claim 2, with an elongated standoff directly fixed at its opposite ends to the bases of the frames of the ties.

10. The tie according to claim 2, further comprising an elongated support having an integral stand, one end of the support being fixed to the base of the tie for locating the stand upon a supporting surface.

11. A method for binding together a pair of adjacent concrete reinforcing bars, comprising the steps of:

placing a first bar in a selected one of a first and a second through passageway in a resilient frame having opposite sides extending from the base, the through passageways being perpendicular to one another and the sides terminating in arcuate claws defining grooves extending parallel to the first through passageway;

placing a second bar in the frame above the first bar and extending in a direction parallel to the first through passageway and grooves, whereby the bars extend parallel to one another if the first bar is positioned in the first through passageway and extend transverse to one another if the first bar is positioned in the second through passageway;

locating a wedge in an initial position wherein the wedge is pivotally engaged with one side of the frame and overlies the second bar; and forcibly driving the wedge from the initial position to an operative position in which the wedge is between the frame and the second bar so that the first and second bars are clamped against one another directly between the wedge and an opposing portion of the frame.

12. The method according to claim 11, wherein the step of locating the wedge in the initial position comprises engaging a lateral extremity on a first side of the wedge in one of the grooves in a first side of the frame, and wherein the step of forcibly driving the wedge to the second position comprises applying a blow to the wedge to drive a lateral extremity on a second side of the wedge into the groove on a second side of the frame opposite the first side of the frame, thereby outwardly biasing the second side of the frame, followed by resilient biasing of the frame inwardly for forcible engagement with the wedge.

13. A method for binding together a pair of adjacent concrete reinforcing bars, comprising the steps of:

providing a resilient frame having opposite sides;

fitting the opposite sides of the frame about a lower first bar and a higher second bar to maintain the first bar and the second bar in adjacent relation;

providing a wedge having an initial position wherein the wedge in the initial position is spaced from the frame in a first direction parallel to the second bar and in overlying relation to the second bar, and an operative position wherein the wedge is between the second bar and both sides of the frame; and forcibly driving the wedge in a second direction opposite to the first direction over the second bar from the initial position to the operative position so that the first and second bars are clamped against one another directly between the wedge and an opposing portion of the frame.

14. The tie according to claim 2, wherein the frame is adapted to support the first and second bars either in a first relative orientation with the first bar extending parallel to the second bar or in a second relative orientation with the first bar extending transverse to the second bar, the elongated wedge comprising means for overlying engagement with the second bar to develop compressive forces upon the bars to bind them together in either the first or second relative orientation of the bars.

15. A concrete reinforcing bar assembly, comprising:

first and second concrete reinforcing bars, the bars being positioned relative to one another in one of two possible orientations in which the second bar overlies the first bar, the orientations comprising a first orientation in which the second bar is parallel to the first bar and a second orientation in which the second bar is perpendicular to the first bar;

a tie for securing the reinforcing bars together in each of the possible orientations, the tie comprising a frame having a frame base and elongated sides extending from the frame base to form a generally U-shaped channel with the frame base for fitting around the reinforcing bars, and an elongated wedge engaging the frame to secure the reinforcing bars in the frame;

the channel extending in a first axial direction, wherein the channel further comprises a channel base, and wherein the channel base supports the first bar extending in the first axial direction when the bars are in the first orientation, the sides of the frame terminating in arcuate claws;

the sides of the base having aligned openings defining a through passage extending in a second axial direction transverse to the first axial direction for supporting the first bar extending in the second axial direction when the bars are in the second orientation, whereby the channel base and the through passage define a first support position and an alternative second support position, respectively, for the first support bar; and the wedge having lateral extremities forcibly located within the arcuate claws of the sides and a surface engaging an opposing surface portion of the second support bar and applying compressive forces upon the first and second reinforcing bars to bind them together in both the first and second orientations.

16. A tie for binding together adjacent concrete reinforcing bars, the tie comprising:

a frame including a base and elongated resilient sides extending from the base and terminating in arcuate claws defining grooves;

the base and sides together defining a generally U-shaped channel extending in a first axial direction, and the grooves in the arcuate claws extending parallel to said first axial direction; and an elongated wedge having lateral extremities adapted for forcible location within the grooves of the arcuate claws;

the base and sides together comprising means for engaging with a concrete reinforcing first bar and a concrete reinforcing second bar stacked on top of the first bar, and the wedge comprising means for engagement with an arcuate upper surface portion of the second bar whereby compressive forces are developed on the first and second bars to force them against one another between the base and the wedge;

wherein each side has an elongate slot extending from its end towards the base, each slot being aligned with one another and having an arcuate lower end, the slots together defining a through passage for selectively receiving the first bar extending in a second axial direction transverse to the first axial direction, with the bar supported on the arcuate lower ends of the slots.

* * * * *